US011981355B2

(12) United States Patent
Araie et al.

(10) Patent No.: US 11,981,355 B2
(45) Date of Patent: May 14, 2024

(54) CARRIER DEVICE AND CONTROL METHOD FOR CARRIER DEVICE

(71) Applicant: Sodick Co., Ltd., Kanagawa (JP)

(72) Inventors: Ichiro Araie, Kanagawa (JP); Taro Hasegawa, Kanagawa (JP)

(73) Assignee: Sodick Co., Ltd., Kanagawa (JP)

( * ) Notice: Subject to any disclaimer, the term of this patent is extended or adjusted under 35 U.S.C. 154(b) by 414 days.

(21) Appl. No.: 17/342,558

(22) Filed: Jun. 9, 2021

(65) Prior Publication Data

US 2022/0001902 A1 Jan. 6, 2022

(30) Foreign Application Priority Data

Jul. 2, 2020 (JP) ..... 2020-114845

(51) Int. Cl.
*B61B 13/08* (2006.01)
*B61B 3/02* (2006.01)

(52) U.S. Cl.
CPC ..... *B61B 13/08* (2013.01); *B61B 3/02* (2013.01)

(58) Field of Classification Search
CPC ..... B61B 13/08; B65G 2812/99
See application file for complete search history.

(56) References Cited

U.S. PATENT DOCUMENTS 4,123,976 A * 11/1978 Nakamura ..... B61B 13/08 310/12.09
4,698,895 A * 10/1987 Miller ..... E01B 25/32 29/525.02
5,156,093 A * 10/1992 Azukizawa ..... B65G 54/02 104/282
2008/0252405 A1* 10/2008 Becker ..... B60L 13/04 335/291
2010/0043667 A1* 2/2010 Loser ..... B60L 3/00 104/284
2019/0100389 A1* 4/2019 Neubauer ..... H02K 7/08

FOREIGN PATENT DOCUMENTS

| | | |
|---|---|---|
| JP | S627305 | 1/1987 |
| JP | H09252504 | 9/1997 |
| JP | 2002104656 | 4/2002 |
| JP | 2018069838 | 5/2018 |
| TW | 201515980 | 5/2015 |
| WO | 2015056847 | 4/2015 |

* cited by examiner

*Primary Examiner* — Rina I Duda
(74) *Attorney, Agent, or Firm* — JCIPRNET

(57) ABSTRACT

A carrier device is provided, which includes: a moving body; a top plate arranged above and separated from the moving body; a magnet plate including a plurality of permanent magnets arranged parallel to a predetermined moving direction on a lower surface of the top plate in a manner that adjacent polarities are different; a moving control coil unit including a plurality of exciting coils arranged on an upper surface of the moving body along and separated from the magnet plate; top gap control coil units including a plurality of exciting coils arranged on the upper surface of the moving body along and separated from the magnet plate; and a controller supplying drive currents respectively to the moving control coil unit and the top gap control coil units to make the moving body move along the moving direction, and controlling a top gap.

10 Claims, 5 Drawing Sheets

CARRIER DEVICE AND CONTROL METHOD FOR CARRIER DEVICE

CROSS-REFERENCE TO RELATED APPLICATION

This application claims the priority benefit of Japan application serial No. 2020-114845, filed on Jul. 2, 2020. The entirety of the above-mentioned patent applications is hereby incorporated by reference herein and made a part of this specification.

BACKGROUND

Technical Field

The disclosure relates to a carrier device and a control method for carrier device. In particular, the disclosure relates to a suspended carrier device driven by a linear motor and a control method thereof.

Related Art

A suspended carrier device driven by a linear motor is known. In the suspended carrier device driven by a linear motor, for example, a rail is set in a ceiling, and an object such as a container is loaded in a bucket suspended from a moving body. The moving body travels along the rail by a linear motor. Generally, in the suspended carrier device driven by a linear motor, a magnet plate is arranged on the rail, and a moving control coil unit including a plurality of exciting coils is arranged on an upper surface of the moving body of a carriage. The magnet plate and the moving control coil unit are arranged to face each other via a predetermined gap (hereinafter referred to as a top gap). When a drive current is supplied to the exciting coils, a magnetic field is generated in the top gap, and the moving body moves in a predetermined direction along the magnet plate.

In the carrier device, a posture holding mechanism is desired to be arranged for maintaining the top gap between the magnet plate and the moving control coil unit and holding the posture of the moving body. For example, in Japanese Patent Laid-Open No. 2018-069838, as the posture holding mechanism, a carrier device including rollers (clearance rollers) in front of and behind the moving body is disclosed. As the moving body moves, the roller contacts the magnet plate (a magnet rail) and rotates to keep the top gap constant.

Because the posture holding mechanism such as the roller does not directly exert an attractive force on the magnet plate, there is a possibility that when the carrying of the moving body is started or stopped, the moving body is tilted because of inertia, and the top gap becomes larger or the moving body comes into contact with other members.

In addition, because the carrier device driven by the linear motor carries the moving body without contact, the carrier device driven by the linear motor is also installed in a space such as a clean room where high cleanliness is required. However, when the posture holding mechanism in a contact type such as the roller is arranged, there is a possibility that dust may be generated at the location contacting with the posture holding mechanism.

SUMMARY

According to an embodiment of the disclosure, a carrier device is provided, which includes: a moving body; a top plate which is arranged above the moving body and separated from the moving body; at least one magnet plate including a plurality of permanent magnets which are arranged parallel to a predetermined moving direction on a lower surface of the top plate in a manner that adjacent polarities are different; a moving control coil unit including a plurality of exciting coils which are arranged on an upper surface of the moving body along a predetermined magnet plate among the at least one magnet plate and separated from the predetermined magnet plate; at least two top gap control coil units including a plurality of exciting coils which are arranged on the upper surface of the moving body along a magnet plate the same as or different from the predetermined magnet plate among the at least one magnet plate and separated from the magnet plate; and a controller which supplies drive currents respectively to the moving control coil unit and the at least two top gap control coil units to make the moving body move along the moving direction, and controls a top gap which is an interval between the magnet plate and the at least two top gap control coil units.

In addition, according to an embodiment of the disclosure, a control method for carrier device is provided, which is a method for controlling a carrier device. The carrier device includes: a moving body; a top plate which is arranged above the moving body and separated from the moving body; at least one magnet plate including a plurality of permanent magnets which are arranged parallel to a predetermined moving direction on a lower surface of the top plate in a manner that adjacent polarities are different; a moving control coil unit including a plurality of exciting coils which are arranged on an upper surface of the moving body along a predetermined magnet plate among the at least one magnet plate and separated from the predetermined magnet plate; and at least two top gap control coil units including a plurality of exciting coils which are arranged on the upper surface of the moving body along a magnet plate the same as or different from the predetermined magnet plate among the at least one magnet plate and separated from the magnet plate. In the control method for carrier device, a drive current is supplied to the moving control coil unit to make the moving body move along the moving direction, and a drive current is supplied to the at least two top gap control coil units to control a top gap which is an interval between the magnet plate and the at least two top gap control coil units.

DESCRIPTION OF THE EMBODIMENTS

According to an embodiment of the disclosure, it is to provide a carrier device capable of maintaining the top gap by a non-contact mechanism and holding the posture of the moving body more accurately.

The carrier device according to an embodiment of the disclosure includes, separately from the moving control coil unit, the top gap control coil units including the plurality of exciting coils. The drive current is supplied to the top gap control coil unit, and thereby an attractive force or a repulsive force between the magnet plate and the top gap control coil unit is generated, the top gap which is the interval between the magnet plate and the top gap control coil units is controlled, and eventually an interval between the magnet plate and the moving control coil unit is controlled to a predetermined size. In this way, the posture of the moving body can be held more accurately. In addition, because the magnet plate and the top gap control coil units are kept in a non-contact state, dust generation is suppressed.

An embodiment of the disclosure is described below with reference to the drawings. Various variation examples described below may be respectively executed in any combination. Moreover, in the following, a direction in which a moving body 2 moves, that is, a left-right direction in FIG. 1, is referred to as a moving direction, and a horizontal direction orthogonal to the moving direction, that is, a left-right direction in FIG. 2 and FIG. 3, is referred to as a width direction.

Figure 1:
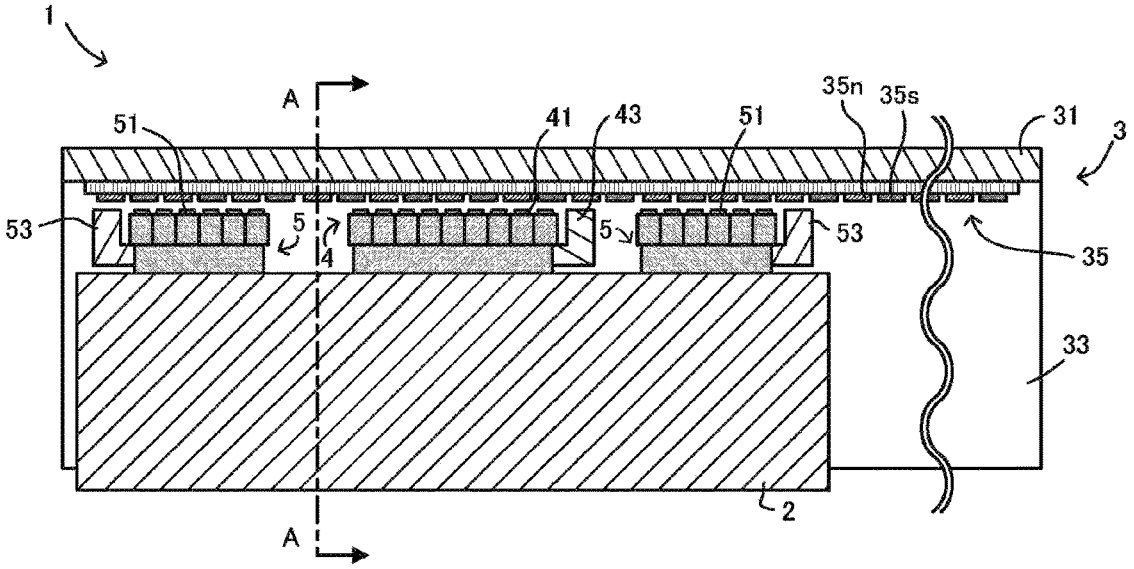
FIG. 1 is a side view of a carrier device according to the embodiment.
Figure 2:
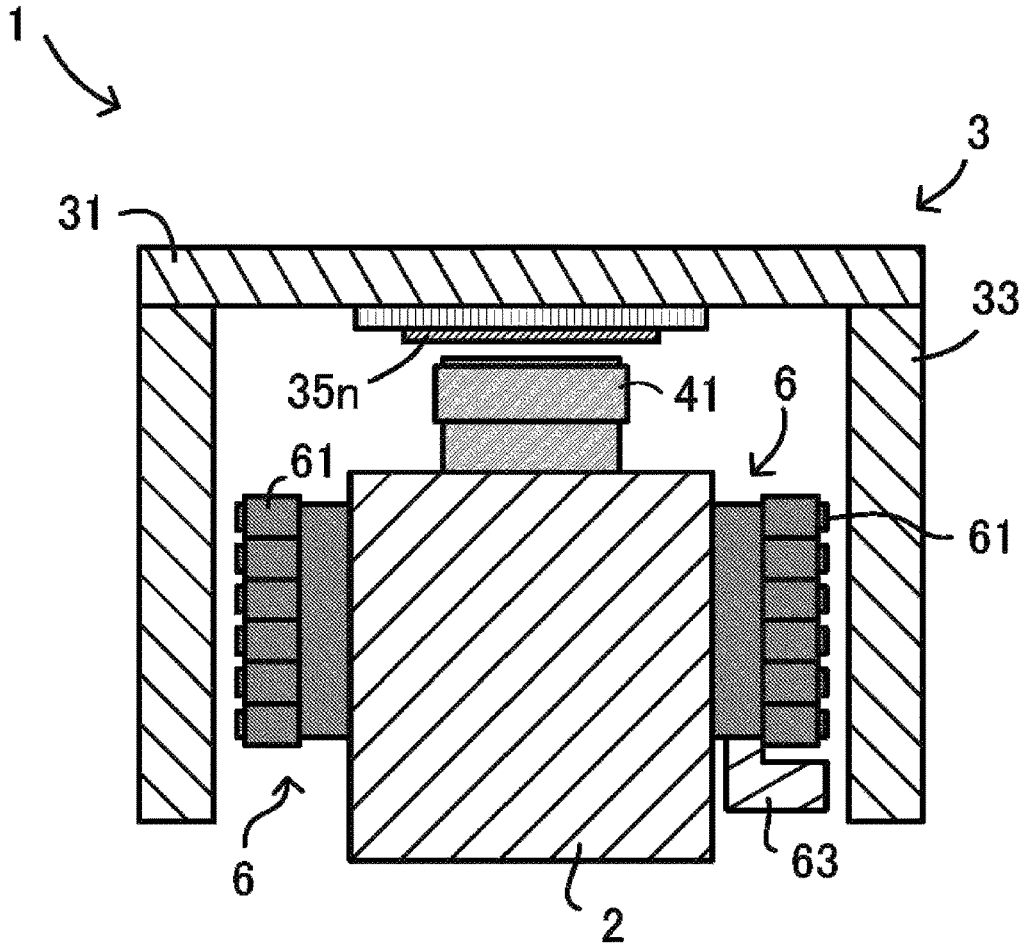
FIG. 2 is a cross-sectional view when viewed from an arrow direction of a line A-A in FIG. 1.
Figure 3:
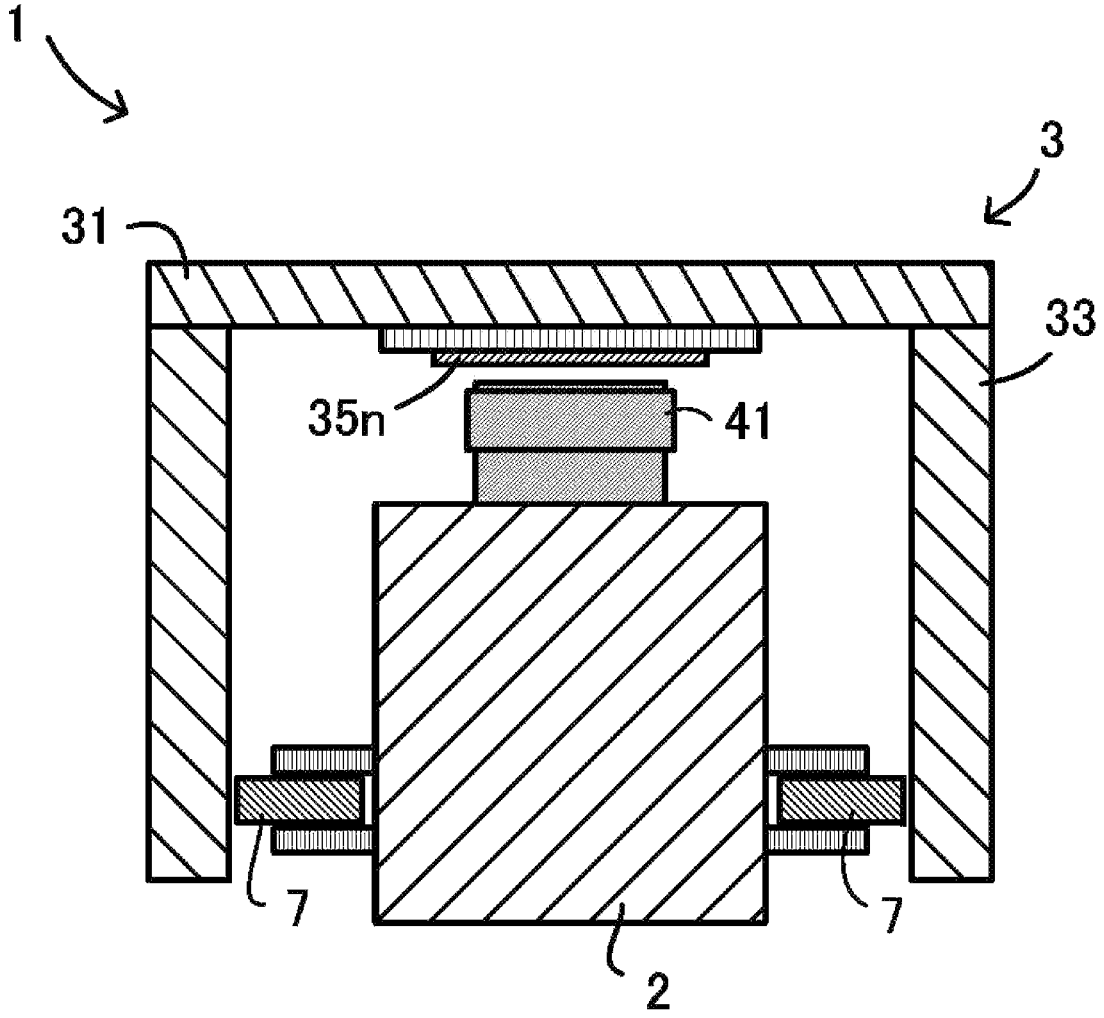
FIG. 3 is a cross-sectional view of a carrier device according to a variation example.

A carrier device 1 of the embodiment shown in FIG. 1 and FIG. 2 is a so-called suspended carrier device driven by a linear motor, which carries a predetermined moving body 2 by a magnetic force generated above the moving body 2. The carrier device 1 of the embodiment includes the moving body 2, a rail 3, a magnet plate 35, a moving control coil unit 4, a position and magnetic pole sensor 43, top gap control coil units 5, top gap sensors 53, side gap control coil units 6, a side gap sensor 63, and a controller 8.

For example, a bucket is suspended from the moving body 2, and an object to be carried is loaded in the bucket. The moving control coil unit 4, the top gap control coil unit 5, the position and magnetic pole sensor 43, and the top gap sensors 53 are respectively attached to an upper surface of the moving body 2. In addition, the side gap control coil units 6 and the side gap sensor 63 are respectively attached to side surfaces of the moving body 2.

The rail 3 is a member which is fixed at a predetermined position in a manner of covering the moving body 2 from above and has, for example, a U-shaped cross section. Specifically, the rail 3 includes a top plate 31 arranged above the moving body 2 and separated from the moving body 2, and a pair of side plates 33 arranged on sides of the moving body 2 and separated from the moving body 2. In the embodiment, the pair of side plates 33 is respectively erected downward from both ends of the top plate 31 in the width direction, but the top plate 31 and the side plates 33 may also be arranged separated from each other.

At least one magnet plate 35 is arranged on a lower surface of the top plate 31. The magnet plate 35 includes a plurality of permanent magnets 35*n* of which the polarity of a surface facing the moving body 2 is N pole and a plurality of permanent magnets 35*s* of which the polarity of a surface facing the moving body 2 is S pole. The permanent magnet 35*n* and the permanent magnet 35*s* are alternately arranged on the top plate 31 in a manner that adjacent polarities are different. In addition, the permanent magnet 35*n* and the permanent magnet 35*s* are arranged parallel to the moving direction. In the embodiment, one magnet plate 35 is arranged at the top plate 31, and as described later, the moving control coil unit 4 and the top gap control coil units 5 share the one magnet plate 35. In this way, the carrier device 1 can be configured to be smaller, which is preferable. However, the magnet plate 35 may be arranged for each of the moving control coil unit 4 and the top gap control coil unit 5. A linear motor is configured in a manner of using the moving control coil unit 4 and the top gap control coil units 5 as the primary side and using the magnet plate 35 as the secondary side.

The moving control coil unit 4 is, for example, a coil unit for a three-phase linear motor with a core including a plurality of exciting coils 41. The exciting coils 41 are arranged on the upper surface of the moving body 2 along the magnet plate 35 and separated from the magnet plate 35. When the exciting coils 41 are excited, by an attractive force and a repulsive force generated between each exciting coil 41 and the permanent magnets 35*n* and 35*s* adjacent to said exciting coil 41, the moving body 2 floats and is carried in the arrangement direction of the permanent magnets 35*n* and 35*s*, that is, the moving direction. The exciting coils 41 may be excited by a three-phase alternating current having three phases including an u-phase, a v-phase, and a w-phase which are shifted by 120°. At this time, an u-phase coil 41*u*, a v-phase coil 41*v*, and a w-phase coil 41*w* respectively excited by an u-phase current, a v-phase current, and a w-phase current are used as one set, and each exciting coil 41 is composed of a predetermined number of the sets.

The position and magnetic pole sensor 43 performs both functions of a position sensor 431 which detects the position of the moving body 2 in the moving direction and a magnetic pole sensor 433 which detects the magnetic field of the permanent magnets 35*n* and 35*s*. The position and magnetic pole sensor 43 is, for example, a magnetic scale. However, the position sensor 431 and the magnetic pole sensor 433 may be respectively individually arranged, and for example, an optical sensor may be arranged as the position sensor 431 and a Hall element may be arranged as the magnetic pole sensor 433. Any sensor may be used as the position sensor 431 and the magnetic pole sensor 433, but non-contact type sensors are preferable. Moreover, in the embodiment, the position and magnetic pole sensor 43 is attached to the moving control coil unit 4, but the position and magnetic pole sensor 43 may also be attached to the moving body 2 directly or indirectly via another member. In addition, in the embodiment, the position sensor 431 and the magnetic pole sensor 433 are used to perform incremental type position measurement when measuring the position and the speed of the moving body 2, but the disclosure is not limited hereto. For example, any linear position detector such as an optical sensor, a capacitance type sensor, a laser interference type sensor, a magnetic type sensor may be used as the position and magnetic pole sensor 43. In addition, absolute type position measurement may also be performed, and at this time, the magnetic pole sensor 433 may be omitted.

Each top gap control coil unit 5 is, for example, a coil unit for a three-phase linear motor with a core including a plurality of exciting coils 51. The exciting coils 51 are arranged on the upper surface of the moving body 2 along the magnet plate 35 and separated from the magnet plate 35. As described above, preferably, the magnet plate 35 facing the exciting coils 41 and the magnet plate 35 facing the exciting coils 51 are the same. That is, the magnet plate 35 may be shared by the exciting coils 41 and the exciting coils 51. However, a plurality of magnet plates 35 may be arranged, and the magnet plates 35 respectively different from each other may be arranged to face the exciting coils 41 and the exciting coils 51. When the exciting coils 51 are excited, a top gap which is an interval between the magnet plate 35 and the top gap control coil unit 5 is controlled by the attractive force or the repulsive force generated between each exciting coil 51 and the permanent magnet 35*n* or the permanent magnet 35*s* facing said exciting coil 51. The exciting coil 51 may be excited by the three-phase alternating current. At this time, an u-phase coil 51*u*, a v-phase coil 51*v*, and a w-phase coil 51*w* respectively excited by the u-phase current, the v-phase current, and the w-phase current are used as one set, and each exciting coil 51 is composed of a predetermined number of the sets. The top gap control coil units 5 are desired to be respectively arranged one each in front of and behind the moving control coil unit 4 in the moving direction across the moving control coil unit 4.

Each top gap sensor 53 detects the size of the top gap, and is, for example, an infrared sensor. Any sensor may be used as the top gap sensor 53, but a non-contact type sensor is preferable. The top gap sensors 53 are desired to be respectively arranged one each in front of and behind the moving control coil unit 4 in the moving direction across the moving control coil unit 4. In the embodiment, each top gap sensor 53 is attached to each top gap control coil unit 5, but the top gap sensor 53 may also be attached to the moving body 2 directly or indirectly via another member.

When the moving control coil unit 4 and the top gap control coil units 5 share the one magnet plate 35, the moving control coil unit 4 and the top gap control coil units 5 are arranged on the same line along the one magnet plate 35. In addition, when the exciting coils 41 of the moving control coil unit 4 are excited, a q-axis current is supplied to the moving control coil unit 4 as a drive current. The q-axis current is converted into the u-phase current, the v-phase current, and the w-phase current, and the u-phase current, the v-phase current, and the w-phase current are respectively supplied to the u-phase coil 41*u*, the v-phase coil 41*v*, and the w-phase coil 41*w*. When the exciting coils 51 of the top gap control coil units 5 are excited, a d-axis current is supplied to the top gap control coil units 5 as a drive current. The d-axis current is converted into the u-phase current, the v-phase current, and the w-phase current, and the u-phase current, the v-phase current, and the w-phase current are respectively supplied to the u-phase coil 51*u*, the v-phase coil 51*v*, and the w-phase coil 51*w*. The d-axis current is a current generating a magnetic field in a direction parallel to the direction of the magnetic field generated by the magnet plate 35, that is, the N pole direction. In addition, the q-axis current is a current orthogonal to the d-axis current. In other words, the d-axis current and the q-axis current are out of phase by 90°.

According to the carrier device 1 having the configuration as described above, the posture of the moving body 2 can be held by controlling the size of the top gap. At this time, the magnet plate 35 and the top gap control coil units 5 are kept in a non-contact state, and thus the dust generation due to the contact is suppressed. In particular, in the embodiment, the moving control coil unit 4 and the top gap control coil units 5 share the one magnet plate 35 to move the moving body 2 and control the top gap, and thus the entire carrier device 1 can be configured to be more compact.

The position of the moving body 2 in the width direction is also desired to be regulated when the moving body 2 is carried. In other words, a side gap which is an interval between the side gap control coil unit 6 and the side plate 33 is desired to be kept constant. In the embodiment, the control of the side gap is performed by the side gap control coil units 6 and the side gap sensor 63.

Each side gap control coil unit 6 is, for example, a single-phase alternating current electromagnet or a direct current electromagnet, including one or more exciting coils 61. The exciting coil 61 is arranged on the side surface of the moving body 2 and separated from the side plate 33. At this time, at least the surface of the side plate 33 facing the exciting coil 61 is a ferromagnet. When the exciting coil 61 is excited, the side gap is controlled by an attractive force generated between each exciting coil 61 and the side plate 33. When the side gap control coil units 6 are the single-phase alternating current electromagnets, the side gap control coil units 6 are excited by a single-phase alternating current. When the side gap control coil units 6 are the direct current electromagnets, the side gap control coil units 6 are excited by a direct current. The side gap control coil units 6 which are single-phase alternating current electromagnets or direct current electromagnets are arranged one each on both side surfaces of the moving body 2.

In addition, the side gap control coil unit 6 may be a coil unit for a three-phase linear motor with a core including a plurality of exciting coils. The exciting coils may be excited by a three-phase alternating current. At this time, an u-phase coil, a v-phase coil, and a w-phase coil respectively excited by the u-phase current, the v-phase current, and the w-phase current are used as one set, and the exciting coils are composed of a predetermined number of the sets. The side gap control coil units 6 which are coil units for the three-phase linear motor with the core may be arranged one each on both side surfaces of the moving body 2. In addition, the magnet plate 35 may be arranged as a ferromagnet on the surface of the side plate 33 facing the exciting coils. In this case, one side gap control coil unit 6 which is the coil unit for a three-phase linear motor with the core may be arranged on the side surface of the moving body 2.

The side gap sensor 63 detects the size of the side gap, and is, for example, an infrared sensor. Any sensor may be used as the side gap sensor 63, but a non-contact type sensor is preferable. In the embodiment, the side gap sensor 63 is attached to one side gap control coil unit 6, but the side gap sensor 63 may also be attached to the moving body 2 directly or indirectly via another member.

In addition, the side gap may be controlled by other mechanism. For example, in a variation example shown in FIG. 3, rollers 7 which are configured to be rotatable in contact with the side plate 33 are arranged one each on both side surfaces of the moving body 2. Moreover, in FIG. 3, the same reference numerals are given to members the same as those in the embodiment, and detailed description is omitted.

From the viewpoint of suppressing the dust generation, the side gap is desired to be controlled by the non-contact type regulating mechanisms such as the side gap control coil units 6 and the side gap sensor 63. However, because the force applied in the width direction during the carrying of the moving body 2 is relatively small, a contact type regulating mechanism such as the roller 7 may be used.

Figure 4:
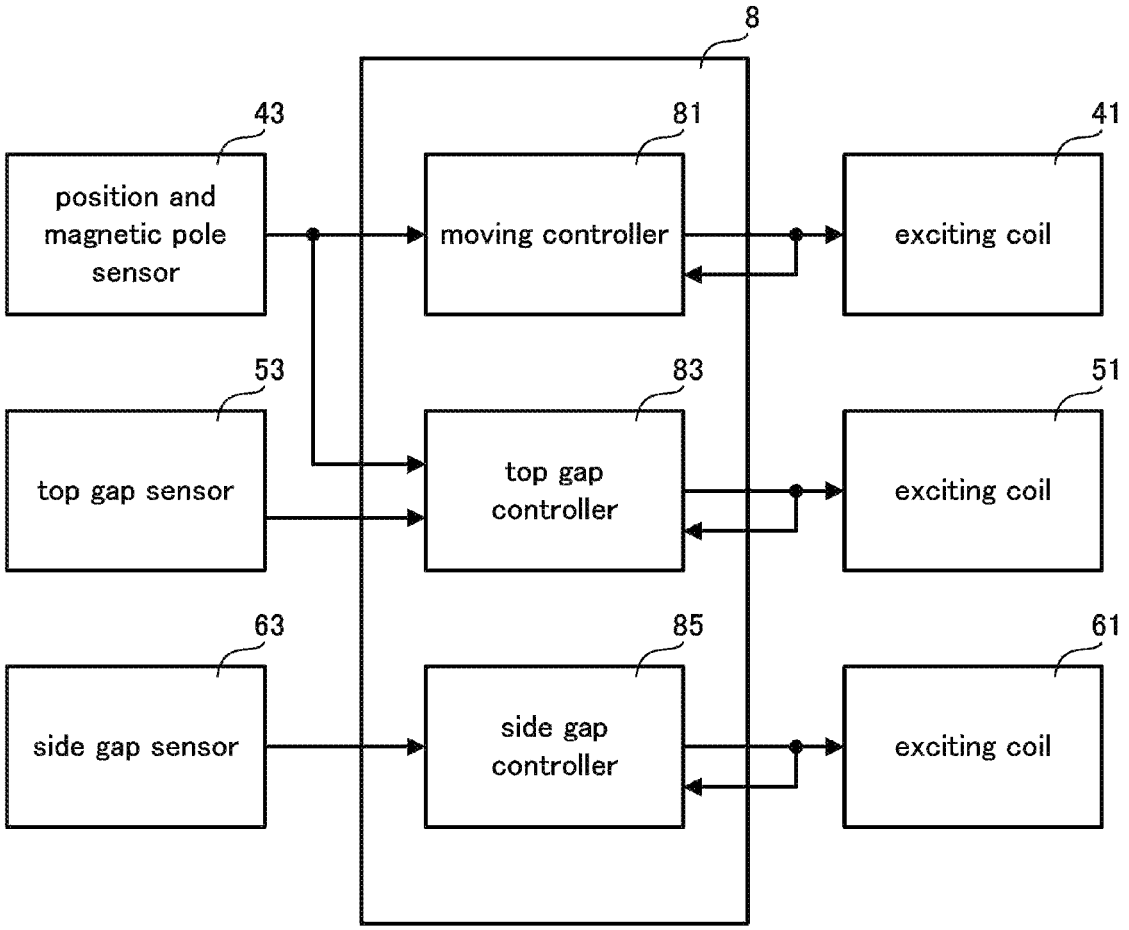
FIG. 4 is a block diagram of a controller according to the embodiment.

The controller 8 supplies the drive currents respectively to the moving control coil unit 4, the top gap control coil units 5, and the side gap control coil units 6 to make the moving body 2 move along the moving direction, and controls the sizes of the top gap and the side gap. As shown in FIG. 4, the controller 8 includes a moving controller 81, a top gap controller 83, and a side gap controller 85.

Figure 5:
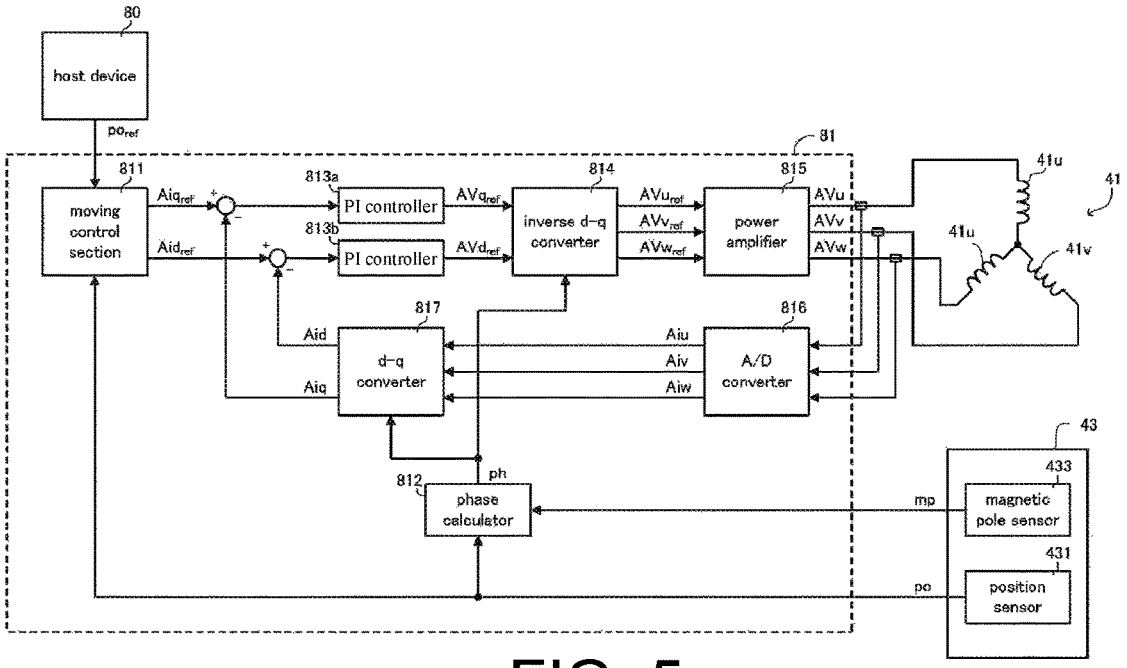
FIG. 5 is a block diagram of a moving controller according to the embodiment.

As shown in FIG. 5, the moving controller 81 has a moving control section 811, a phase calculator 812, PI controllers 813*a* and 813*b*, an inverse d-q converter 814, a power amplifier 815, an A/D converter 816, and a d-q converter 817.

A magnetic pole signal mp indicating the magnetic field of the permanent magnets 35*n* and 35*s* detected by the magnetic pole sensor 433 and a position signal po indicating the present position of the moving body 2 detected by the position sensor 431 are input to the phase calculator 812. The phase calculator 812 calculates a phase of the magnetic field of the magnet plate 35 based on the magnetic pole signal mp and the position signal po, and outputs a phase signal ph indicating the phase of the magnetic field of the magnet plate 35 to the inverse d-q converter 814 and the d-q converter 817.

The moving control section 811 calculates a target position and a target speed of the moving body 2 based on a moving command $po_{ref}$ input from a host device 80 and the position signal po input from the position sensor 431. A thrust force in the moving direction generated by the moving control coil unit 4 with respect to the magnet plate 35 is proportional to a q-axis current value Aiq. Therefore, the moving control section 811 outputs a q-axis current command $Aiq_{ref}$ to the PI controller 813*a* in order to supply the q-axis current to the moving control coil unit 4 as the drive current. On the other hand, the moving controller 81 does not supply the d-axis current to the moving control coil unit 4. That is, the moving control section 811 outputs a d-axis current command $Aid_{ref}$ having a value of 0 to the PI controller 813*b*.

The PI controller 813*a* and the PI controller 813*b* respectively perform PI calculation to convert the q-axis current command $Aiq_{ref}$ into a q-axis voltage command $AVq_{ref}$ and convert the d-axis current command $Aid_{ref}$ into a d-axis voltage command $AVd_{ref}$. Based on the phase signal ph, the inverse d-q converter 814 applies an inverse d-q conversion to the q-axis voltage command $AVq_{ref}$ and the d-axis voltage command $AVd_{ref}$, calculates an u-phase voltage command $AVu_{ref}$, a v-phase voltage command $AVv_{ref}$, and a w-phase voltage command $AVw_{ref}$, and outputs the u-phase voltage command $AVu_{ref}$, the v-phase voltage command $AVv_{ref}$, and the w-phase voltage command $AVw_{ref}$ to the power amplifier 815.

Based on the u-phase voltage command $AVu_{ref}$, the v-phase voltage command $AVv_{ref}$, and the w-phase voltage command $AVw_{ref}$, the power amplifier 815 supplies an u-phase voltage AVu, a v-phase voltage AVv, and a w-phase voltage AVw which are desired respectively to the u-phase coil 41*u*, the v-phase coil 41*v*, and the w-phase coil 41*w* of the moving control coil unit 4.

In this way, the magnetic field which is out of phase by about 90° with the magnetic field generated in the magnet plate 35 is generated in the moving control coil unit 4, and the moving body 2 travels in the desired moving direction by the magnetic force mutually generated between the moving control coil unit 4 and the magnet plate 35.

Moreover, feedback control is desired to be performed during the moving control of the moving body 2. Specifically, the A/D converter 816 reads values of the u-phase voltage AVu, the v-phase voltage AVv, and the w-phase voltage AVw which are output by the power amplifier 815, and converts the values into an u-phase current value Aiu, a v-phase current value Aiv, and a w-phase current value Aiw. Based on the phase signal ph, the d-q converter 817 applies a d-q conversion to the u-phase current value Aiu, the v-phase current value Aiv, and the w-phase current value Aiw, and calculates the q-axis current value Aiq and a d-axis current value Aid. The q-axis current command $Aiq_{ref}$ and the d-axis current command $Aid_{ref}$ are corrected by the q-axis current value Aiq and the d-axis current value Aid.

Figure 6:
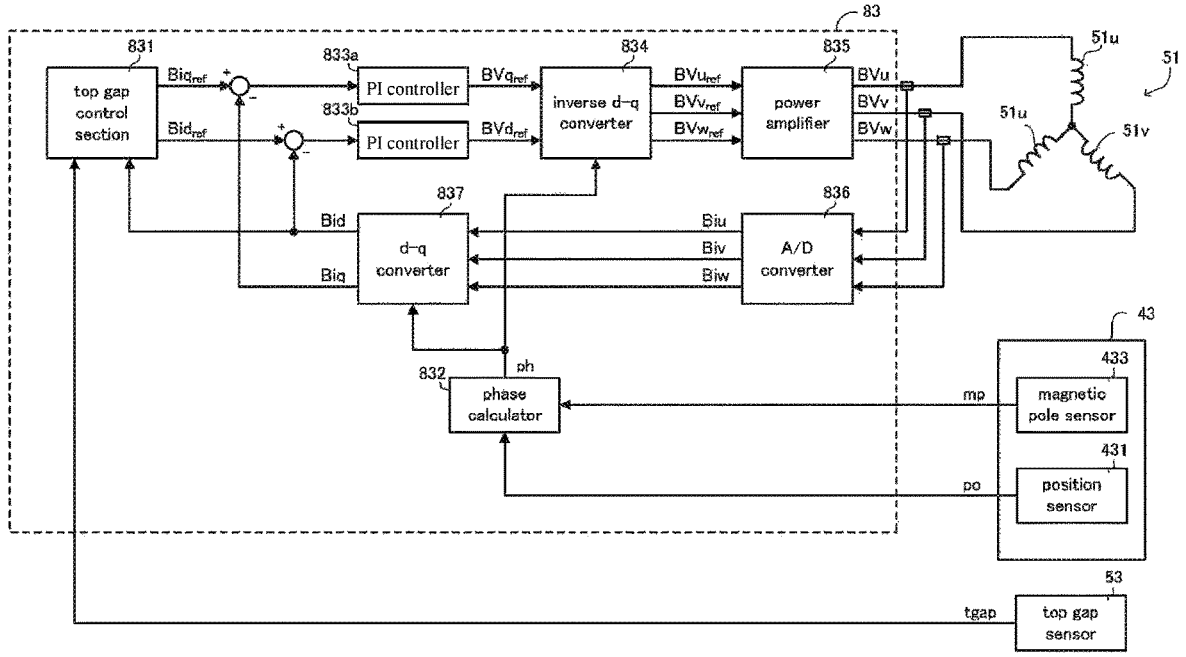
FIG. 6 is a block diagram of a top gap controller according to the embodiment.

As shown in FIG. 6, the top gap controller 83 has a top gap control section 831, a phase calculator 832, PI controllers 833*a* and 833*b*, an inverse d-q converter 834, a power amplifier 835, an A/D converter 836, and a d-q converter 837.

The magnetic pole signal mp and the position signal po are input to the phase calculator 832. The phase calculator 832 outputs the phase signal ph to the inverse d-q converter 834 and the d-q converter 837 based on the magnetic pole signal mp and the position signal po. Moreover, the phase calculator 812 and the phase calculator 832 may be respectively individually arranged in the moving controller 81 and the top gap controller 83, or one phase calculator may be used to perform both functions of the phase calculator 812 and the phase calculator 832.

The top gap control section 831 calculates a correction value of the top gap based on a top gap signal tgap indicating the size of the current top gap input from the top gap sensor 53, a d-axis current value Bid input from the d-q converter 837, and a predetermined set value. The attractive force or the repulsive force in the vertical direction generated by the top gap control coil units 5 with respect to the magnet plate 35 correlates with the d-axis current value Bid. Therefore, the top gap control section 831 outputs a d-axis current command $Bid_{ref}$ to the PI controller 833*b* in order to supply the d-axis current to the top gap control coil units 5 as the drive current. On the other hand, the top gap controller 83 does not supply the q-axis current to the top gap control coil units 5. That is, the top gap control section 831 outputs a q-axis current command $Biq_{ref}$ having a value of 0 to the PI controller 833*a*.

The PI controller 833*a* and the PI controller 833*b* respectively perform the PI calculation to convert the q-axis current command $Biq_{ref}$ into a q-axis voltage command $BVq_{ref}$ and convert the d-axis current command $Bid_{ref}$ into a d-axis voltage command $BVd_{ref}$. Based on the phase signal ph, the inverse d-q converter 834 applies the inverse d-q conversion to the q-axis voltage command $BVq_{ref}$ and the d-axis voltage command $BVd_{ref}$, calculates an u-phase voltage command $BVu_{ref}$, a v-phase voltage command $BVv_{ref}$, and a w-phase voltage command $BVw_{ref}$, and outputs the u-phase voltage command $BVu_{ref}$, the v-phase voltage command $BVv_{ref}$, and the w-phase voltage command $BVw_{ref}$ to the power amplifier 835.

Based on the u-phase voltage command $BVu_{ref}$, the v-phase voltage command $BVv_{ref}$, and the w-phase voltage command $BVw_{ref}$, the power amplifier 835 supplies an u-phase voltage BVu, a v-phase voltage BVv, and a w-phase voltage BVw which are desired respectively to the u-phase coil 51*u*, the v-phase coil 51*v*, and the w-phase coil 51*w* of the top gap control coil units 5.

In this way, in the top gap control coil units 5, a magnetic field in a direction parallel to the direction of the magnetic field generated by the magnet plate 35, that is, a magnetic field which is in phase with the N phase of the magnetic field generated in the magnet plate 35, is generated, and the top gap is maintained in a desired size by the magnetic force mutually generated between the top gap control coil units 5 and the magnetic force plate 35.

Moreover, the feedback control is desired to be performed during the top gap control. Specifically, the A/D converter 836 reads values of the u-phase voltage BVu, the v-phase voltage BVv, and the w-phase voltage BVw which are output by the power amplifier 835, and converts the values into an u-phase current value Biu, a v-phase current value Biv, and a w-phase current value Biw. Based on the phase signal ph, the d-q converter 837 applies the d-q conversion to the u-phase current value Biu, the v-phase current value Biv, and the w-phase current value Biw, and calculates a q-axis current value Biq and a d-axis current value Bid. The q-axis current command $Biq_{ref}$ and the d-axis current command $Bid_{ref}$ are corrected by the q-axis current value Biq and the d-axis current value Bid.

Here, the magnitude of the drive current supplied to the top gap control coil units 5, that is, the d-axis current, is desired to be controlled in a manner that a gravity force of the entire movable section consisting of the moving body 2 and members fixed to the moving body 2 and the attractive force between the top gap control coil units 5 and the magnet plate 35 are balanced. That is, a so-called zero power control is desired to be performed in the top gap control coil units 5. In the embodiment, the members fixed to the moving body 2 specifically include the moving control coil unit 4, the position and magnetic pole sensor 43, the top gap control coil units 5, the top gap sensors 53, the side gap control coil units 6, the side gap sensor 63, the bucket suspended from the moving body 2, and the object to be carried which is loaded in the bucket. If the gravity force of the entire movable section including the moving body 2 and the members fixed to the moving body 2 is set to G, the attractive force generated in the moving control coil unit 4 is set to $P_1$, and the attractive force generated in one top gap control coil unit 5 is set to $P_2$, when $P_2$ becomes $\{(G-P_1)/(\text{the number of top gap control coil units } \mathbf{5})\}$, the attractive force between the top gap control coil units 5 and the magnet plate 35 is balanced. The top gap controller 83 controls the top gap in a manner that the gravity force of the entire movable section and the attractive force between the top gap control coil units 5 and the magnet plate 35 are balanced, and thereby the value of the drive current supplied to the top gap control coil units 5 can be substantially 0, and the electric power consumption can be suppressed. That is, the top gap is desired to be controlled to a value at which the drive current becomes substantially 0, but not a value commanded from the host device 80 or the like.

Figure 7:
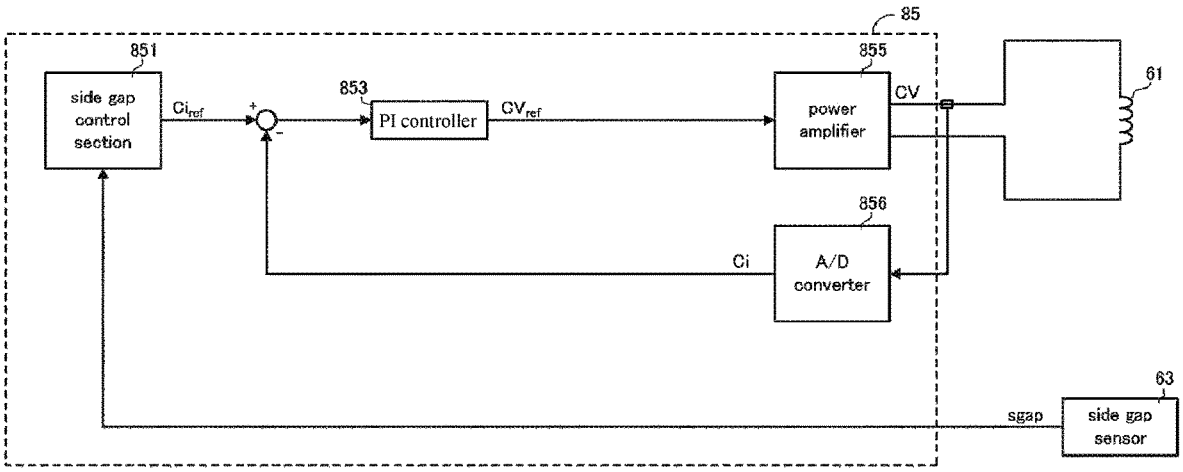
FIG. 7 is a block diagram of a side gap controller according to the embodiment.

As shown in FIG. 7, the side gap controller 85 has a side gap control section 851, a PI controller 853, a power amplifier 855, and an A/D converter 856.

The side gap control section 851 calculates a correction value of the side gap based on a side gap signal sgap indicating the size of the current side gap input from the side gap sensor 63 and a predetermined set value. Then, the side gap control section 851 outputs a current command $Ci_{ref}$ to the PI controller 853.

The PI controller 853 performs the PI calculation to convert the current command $Ci_{ref}$ into a voltage command $CV_{ref}$, and outputs the voltage command $CV_{ref}$ to the power amplifier 855.

The power amplifier 855 supplies a desired voltage CV to the exciting coils 61 of the side gap control coil units 6 based on the voltage command $CV_{ref}$.

In this way, the side gap is maintained in a desired size by a magnetic force mutually generated between the side gap control coil units 6 and the side plate 33.

Moreover, the feedback control is desired to be performed during the side gap control. Specifically, the A/D converter 856 reads a value of the voltage CV output by the power amplifier 855, and converts the value into a current value Ci. The current command $Ci_{ref}$ is corrected by the current value Ci.

The side gap controller 85 described above shows a configuration when each side gap control coil unit 6 is the single-phase alternating current electromagnet or the direct current electromagnet. As described above, the side gap control coil unit 6 may be the coil unit for the three-phase linear motor with the core.

As several examples have already been specifically shown, the disclosure is not limited to the configuration of the embodiment shown in the drawings, and various modifications or applications may be made without departing from the technical idea of the disclosure.

What is claimed is:

1. A carrier device, comprising:

a moving body;

a top plate which is arranged above the moving body and separated from the moving body;

at least one magnet plate comprising a plurality of permanent magnets which are arranged parallel to a predetermined moving direction on a lower surface of the top plate in a manner that adjacent polarities are different;

a moving control coil unit comprising a plurality of exciting coils which are arranged on an upper surface of the moving body along a predetermined magnet plate among the at least one magnet plate and separated from the predetermined magnet plate;

at least two top gap control coil units comprising a plurality of exciting coils which are arranged on the upper surface of the moving body along the predetermined magnet plate among the at least one magnet plate and separated from the magnet plate; and a controller which supplies drive currents respectively to the moving control coil unit and the at least two top gap control coil units to make the moving body move along the moving direction, and controls a top gap which is an interval between the magnet plate and the at least two top gap control coil units, wherein the moving control coil unit and the at least two top gap control coil units are arranged on the same line along the predetermined magnet plate; and the controller supplies a d-axis current to the at least two top gap control coil units as the drive current, wherein the d-axis current is a current generating a magnetic field in a direction parallel to a direction of a magnetic field generated by the predetermined magnet plate, and supplies a q-axis current to the moving control coil unit as the drive current, wherein the q-axis current is orthogonal to the d-axis current.

2. The carrier device according to claim 1, wherein the at least two top gap control coil units are respectively arranged in front of and behind the moving control coil unit in the moving direction across the moving control coil unit.

3. The carrier device according to claim 1, further comprising a position sensor which detects a position of the moving body in the moving direction.

4. The carrier device according to claim 1, further comprising at least one top gap sensor which detects a size of the top gap.

5. The carrier device according to claim 4, wherein the at least one top gap sensor comprises at least two top gap sensors;

the at least two top gap sensors are respectively arranged in front of and behind the moving control coil unit in the moving direction across the moving control coil unit.

6. The carrier device according to claim 1, further comprising a pair of side plates arranged on sides of the moving body and separated from the moving body.

7. The carrier device according to claim 6, further comprising at least one side gap control coil unit that comprises exciting coils arranged on a side surface of the moving body and separated from the side plates, wherein at least a surface of the side plates facing the exciting coil is a ferromagnet, and the controller supplies a current to the at least one side gap control coil unit, and controls a side gap which is an interval between the side gap control coil unit and one of the side plates.

8. The carrier device according to claim 7, further comprising a side gap sensor which detects a size of the side gap.

9. The carrier device according to claim 6, further comprising rollers which are arranged on side surfaces of the moving body and are configured to be rotatable in contact with the side plates.

10. The carrier device according to claim 1, wherein the controller supplies the drive current to the at least two top gap control coil units in a manner that a gravity force of an entire movable section and an attractive force between the at least two top gap control coil units and the predetermined magnet plate are balanced, wherein the movable section consists of the moving body and members fixed to the moving body.

* * * * *